United States Patent [19]

Sawai et al.

[11] Patent Number: 4,979,558

[45] Date of Patent: Dec. 25, 1990

[54] PROCESS FOR PREPARATION OF A CASTING HAVING MNS DISPERSED AND UNIFORMLY AND FINELY PRECIPITATED THEREIN

[75] Inventors: Takashi Sawai, Kawasaki; Hidetoshi Yuyama, Oita; Yoshiyuki Ueshima; Shozo Mizoguchi, both of Kawasaki, all of Japan

[73] Assignee: Nippon Steel Corporation, Tokyo, Japan

[21] Appl. No.: 321,164

[22] Filed: Mar. 9, 1989

[30] Foreign Application Priority Data

Mar. 9, 1988 [JP] Japan ..... 63-53458

[51] Int. Cl.[5] ..... B22D 11/10; B22D 11/124

[52] U.S. Cl. ..... 164/473; 164/58.1; 164/122; 164/485

[58] Field of Search ..... 164/473, 485, 459, 57.1, 164/58.1, 122, 47

[56] References Cited

U.S. PATENT DOCUMENTS 4,614,223 9/1986 Wilson ..... 164/473
4,806,304 2/1989 Kimura et al. ..... 164/473 X

FOREIGN PATENT DOCUMENTS 0177851 4/1986 European Pat. Off. .
3146950 6/1982 Fed. Rep. of Germany .
57-126951 8/1982 Japan ..... 164/473
57-126952 8/1982 Japan ..... 164/473
61-162253 7/1986 Japan ..... 164/473
61-238940 10/1986 Japan .
62-130756 6/1987 Japan ..... 164/473
62-156056 7/1987 Japan ..... 164/473
1-62254 3/1989 Japan ..... 164/473

OTHER PUBLICATIONS

Abstract of Japanese Patent Publication 61-238940 Published Oct. 24, 1986.
Abstract of Japanese Patent Publication 62-109948 Published May 21, 1987.
"Tetsu-to-Hagane", vol. 65, No. 8 (1979) p. 1232.
"Tetsu-to-Hagane", 1987, S197.
"JSPS", 19th-Com. Rept. 10835 (1987).

*Primary Examiner*—Richard K. Seidel
*Assistant Examiner*—J. Reed Batten, Jr.
*Attorney, Agent, or Firm*—Wenderoth, Lind & Ponack

[57] ABSTRACT

MnS is finely dispersed and precipitated in a steel, and the steel obtained has highly improved characteristics such as HAZ toughness, cold cracking resistance, and corrosion resistance. This steel is obtained by continuously casting a component-adjusted molten steel having a dissolved oxygen concentration of 20 to 60 ppm and containing 0.01 to 0.05% by weight of a deoxidizing element, at a specific cooling rate.

10 Claims, 5 Drawing Sheets

PROCESS FOR PREPARATION OF A CASTING HAVING MNS DISPERSED AND UNIFORMLY AND FINELY PRECIPITATED THEREIN

BACKGROUND OF THE INVENTION (1) Field of the Invention

The present invention relates to a process for manufacturing a steel having MnS finely and uniformly precipitated therein, with a deoxidation product as a nucleus, by specially a continuous casting method.

(2) Description of the Related Art

Requirements for the properties of materials of large constructions such as marine structures, ships and store tanks have become severe, and drastic improvements of toughness are desired. In general, in the austenite-to-ferrite transformation of steel, coarse ferrite is precipitated from the grain boundary of austenite and the texture becomes coarse. Furthermore, when a steel material is subjected to automatic welding such as submerged arc welding, electro-gas welding or electroslag welding, the texture of the welding heat-affected zone (hereinafter referred to "HAZ") is further coarsened. It is known that the toughness of the steel is reduced as the texture is coarsened, and various processes for making the texture fine have been proposed, for improving the toughness.

For example, Japanese Unexamined Patent Application No. 61-238940 discloses a process for making the texture fine, in which the intragranular ferrite plates (called "IFP" hereinafter) are formed in austenite grains by using inclusions dispersed in steel as transformation nuclei, and "Tetsu-to-Hagan", Vol. 65, No. 8 (1979), page 1232 teaches a method for improving the HAZ toughness of a high strength steel of 50 kg/mm$^2$ upon a large heat input welding by finely dispersing and precipitating TiN. However, this method is defective in that, in the vicinity of the bonded portion, coarsening by a re-dissolution of TiN and degradation of the HAZ toughness by an increase of dissolved N cannot be avoided.

Several inclusions such as MnS, TiN, REM, Ca, TiO and $Ti_2O_3$ have been found effective as the transformation nucleus of IFP, but since MnS is generally precipitated in a micro-segregated portion having a high hardenability, it is difficult for MnS to act as a transformation nucleus of IFP.

In "Tetsu-to-Hagan", 1987, S197 and JSPS, 19th-Com. Rept. 10835 (1987), the present inventors clarified that deoxidation is carried out with Al, Ti, Zr or the like and fine MnS is precipitated by using the deoxidation product as the nucleus, but it is necessary to increase the number of MnS precipitates as the transformation nuclei of IFP in steel.

Accordingly, to make the texture fine by utilizing IFP, i.e., to drastically increase the toughness, a method must be established in which (1) an inclusion (for example, MnS) acting as the transformation nucleus of IFP is made uniform and ultrafine, and (2) an inclusion acting as the transformation nucleus of IFP even upon large heat input welding, and having an excellent high-temperature stability, is uniformly and ultrafinely dispersed.

SUMMARY OF THE INVENTION

Under this background, a primary object of the present invention is to provide a process for finely and uniformly dispersing MnS in a steel.

Another object of the present invention is to provide a process for preparing a casting steel having a high toughness by finely and uniformly dispersing MnS in a continuous casting.

In view of the above objects, the present inventors carried out research into the deoxidizing step usually indispensable for the manufacture of steel, and into the behavior of not only weak deoxidizing elements such as Ti and Si but also strong deoxidizing elements such as Al, Ca and REM in the molten steel, at the step of solidification and during cooling. As the result, it was found that an inclusion acting as an IFP transformation nucleus capable of being finely and uniformly dispersed in a matrix having an excellent high-temperature stability to make the texture fine by IFP, acts as follows.

In the melting and solidifying test of an ingot of 1 kg, deoxidation was carried out to obtain a target total oxygen concentration of 300 ppm and the melt was naturally cooled in Ar for solidification. It was found that all of the deoxidation products, including those impinging and coagulating in the melt, such as $Al_2O_3$, $Ti_2O_3$, $Y_2O_3$, $Ce_2O_3$, $ZrO_2$, $HfO_2$ and $MnO.ZrO_2$, act as the nucleus, and fine precipitates of MnS having a size of several $\mu$m are formed around such deoxidation products. Furthermore, it was confirmed that MnS precipitated with the deoxidation product as the nucleus (hereinafter referred to as "oxy-sulphide") functions as the IFP nucleus.

Nevertheless, it was found that, to obtain a sufficient low-temperature toughness, a greater number of oxy-sulphide must be obtained, and accordingly, further research was carried out into the concentration of dissolved oxygen before the deoxidation, and the cooling rate at the casting step. As the result, it was found that correlations existed between these factors and the sizes and number of the deoxidation products and oxy-sulphide precipitates.

Based on these results, the present inventors found that, by incorporating and dissolving an element (hereinafter referred to as "deoxidizing element") such as Zr, Ti, Ce, Y or Hf in a molten steel having a predetermined dissolved oxygen concentration, and cooling the melt at a predetermined rate, MnS having a function of the IFP transformation nucleus can be uniformly and finely precipitated with the deoxidation product having an excellent high-temperature stability as the nucleus, and the present invention is based on this finding.

More specifically, in accordance with the present invention, there is provided a process for the preparation of a casting of a steel having MnS finely dispersed and precipitated therein, which comprises casting in a casting mold a component-adjusted steel formed by adjusting the dissolved oxygen concentration to 20 to 60 ppm and adding 0.01 to 0.05% by weight of one element selected from the group consisting of Zr, Ti, Ce, Y and Hf, and cooling the formed casting while controlling the average cooling rate at the final solidification position of the casting so that the average cooling rate is at least 50° C./min at temperatures of from the liquidus line temperature to 1400° C. and the average cooling rate is 1 to 50° C./min at temperatures lower than 1400° C. but higher than 1300° C.

According to this process, a large quantity of fine MnS can be uniformly dispersed in the steel and the low-temperature toughness of the steel can be greatly improved.

DESCRIPTION OF THE PREFERRED EMBODIMENTS

Figure 1:
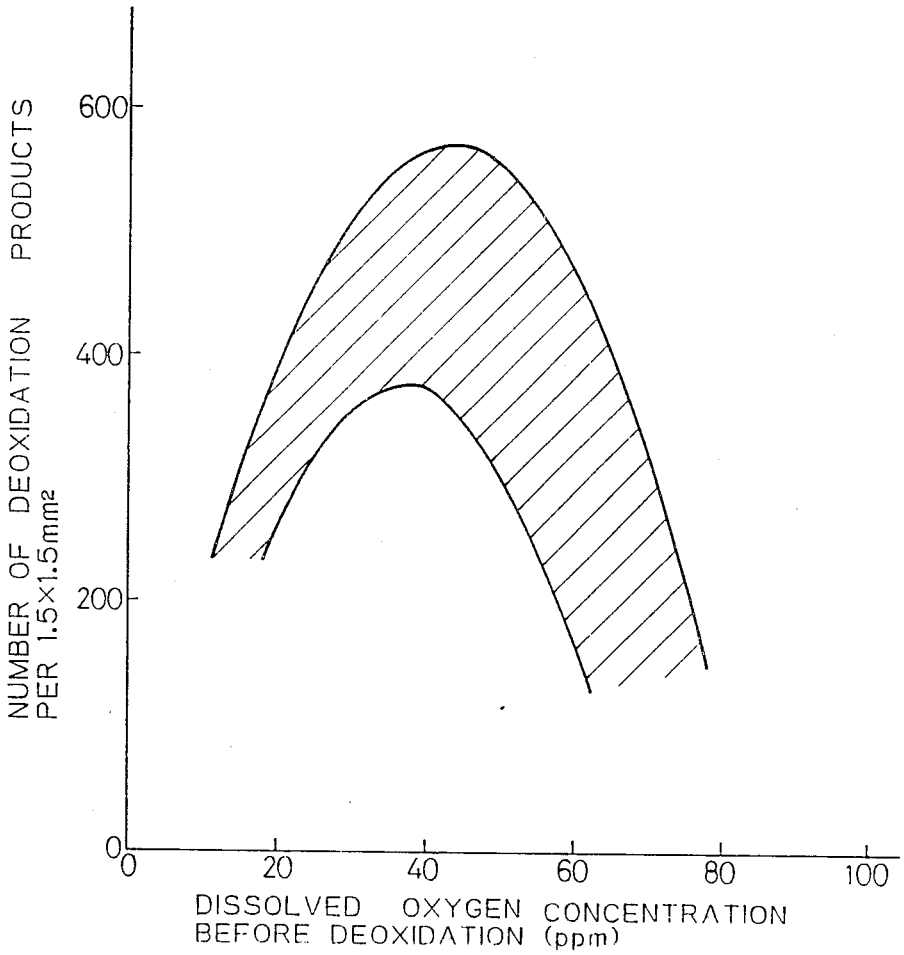
FIG. 1 is a diagram showing the concentration of dissolved oxygen before the deoxidation and the number of deoxidation products.

The components in the steel, characterizing the present invention, will now be described.

The deoxidizing element used in the present invention is an element having a binding force to dissolved oxygen, such as Zr, Ti, Ce, Y or Hf.

If the target content of the deoxidizing element is lower than 0.01% by weight, the amount of the oxide formed by reaction with dissolved oxygen is small and substantially no effect is obtained. If the amount of the deoxidizing element exceeds 0.05% by weight, the amount of deoxidation products formed just after incorporation is excessive and the deoxidation products coagulate, and the coagulated deoxidation products rise and separate. Accordingly, the amount of the deoxidizing element is adjusted to 0.01 to 0.05% by weight, most preferably about 0.2% by weight.

If the concentration of dissolved oxygen after the adjustment of the components (hereinafter referred to as "the concentration of dissolved oxygen before the deoxidation") is lower than 20 ppm, the amount of the deoxidation products formed by reaction with the deoxidizing element is small, and substantially no effect is obtained. If the concentration of dissolved oxygen before the deoxidation is higher than 60 ppm, an excessive amount of the deoxidation products is formed just after incorporation of the deoxidizing element and the deoxidation products coagulate, and the coagulated deoxidation products rise and separate, with the result that all of the formed deoxidation products are substantially released from the steel. Accordingly, the dissolved oxygen concentration is adjusted to 20 to 60 ppm.

The preliminary deoxidation for adjusting the oxygen concentration to 20 to 60 ppm is effected with Al, Si, Zr, Ti, Ce, Y or Hf. A ladle treatment such as a reduced pressure treatment can be performed in combination with the preliminary deoxidation according to need. The concentration of dissolved oxygen before the deoxidation is measured by an oxygen probe before the addition of the deoxidizing element.

Where the concentration of dissolved oxygen is lower than 20 ppm, by adding oxygen capable of being bonded to the deoxidizing element in an amount corresponding to 20 to 60 ppm by weight after the addition of a predetermined amount of the deoxidizing element, a desired amount of fine deoxidation products can be obtained. As the means for adding oxygen, there can be adopted either a method in which gaseous oxygen is blown into the melt or a method in which an oxide of an element having a weaker bonding force than the deoxidizing element to be added is added to the melt.

In this case, the amount of gaseous oxygen or the oxide to be added in view of the weight of the melt and the yield of oxygen, so that the concentration of dissolved oxygen corresponds to 20 to 60 ppm.

The amount corresponding to 20 to 60 ppm means that the sum of gaseous oxygen or the oxide dissolved in the melt is 20 to 60 ppm based on the weight of the melt.

The molten steel used in the present invention is a usual Si-Mn type carbon steel, but naturally a multipurpose steel containing special components can be used in the present invention. Preferably, the contents of Mn and S as main components are such that the concentration product of Mn and S at or after the solidification exceeds the equilibrium solubility product of the δ-phase or γ-phase. For example, the equilibrium solubility product is expressed by the formula of $\log[\%Mn][\%S] \geqq -10590/T+4.092$ in δ−Fe [H.A. Wried and Hsun Hu, Met. Trans., 7A (1976), page 711], or $\log[\%Mn][\%S] \geqq -9020/T+2.929-(-215/T+0.097-)[\%Mn]$ in γ-Fe [E.T. Turkdogan, S. Ignatowitz and J. Pearson, JISI, 180 (1955), page 349].

The step of cooling the casting, which constitutes another characteristic feature of the present invention, will now be described.

After the dissolved oxygen concentration in the component-adjusted molten steel is adjusted and a predetermined amount of the deoxidizing element is added to the melt, as an example, a continuous casting is formed from the melt by a continuous casting apparatus. To prevent a rising and separating of the coagulating deoxidation products from the melt, the time from the point of addition of the deoxidizing element to the point of initiation of the casting operation must be as short as possible, preferably under 10 minutes.

In connection with the cooling rate at the casting step, the average cooling rate at the position of the final solidification of the casting must be at least 50° C./min at temperatures of from the liquidus line temperature to 1400° C. If this average cooling rate is lower than 50° C./min, the time during which the deoxidation product acting as the precipitation nucleus of MnS is present in the solid-liquid copresent temperature range is prolonged, substantially all of the deoxidation products coagulate, rise and separate, and the coagulated deoxidation products are released from the melt. Moreover, the solidified texture is coarsened and the distribution of the deoxidation products becomes uneven, and the micro-segregation of Mn and S increases and the precipitation of MnS becomes uneven. Namely, in the above-mentioned temperature range, by increasing the cooling rate as much as possible, the deoxidation products can be finely and uniformly formed, and the micro-segregation of Mn and S is prevented.

At temperatures lower than 1400° C. but higher than 1300° C., the average cooling rate at the position of the final solidification of the casting is adjusted to 1 to 50° C./min. In this temperature range, MnS is precipitated on the fine deoxidation products as the nucleus. If the above-mentioned cooling rate is lower than 1° C./min, since the precipitation time is too long, MnS precipitated on the deoxidation products as the nucleus is coarsened to a size of scores of μm, and good results cannot be obtained with respect to crack sensitivity. If the above-mentioned cooling rate exceeds 50° C./min, sufficient time is not allowed for a diffusion of Mn, and Mn is fixed on the matrix without a sufficient diffusion of Mn on the deoxidation products, and therefore, the precipitation of MnS is unsatisfactory and the number of MnS precipitates as the IFP transformation nucleus is too low. Accordingly, the above-mentioned average cooling rate is adjusted to 1 to 50° C./min.

When the average cooling rate at the final solidification position of the casting is estimated by a calculation of the heat transfer, by using the surface temperature of the casting, and at the continuous casting step, the above-mentioned requirements of the cooling rate can be satisfied, for example, by arranging a heating zone in the continuous casting machine.

The present invention will now be described in detail with reference to the following examples that by no means limit the scope of the invention.

Example 1

A molten steel having a composition shown in Table 1 was prepared in a vacuum melting furnace, the concentration of dissolved oxygen before the deoxidation was adjusted to 10 to 80 ppm, and deoxidation was carried out by adding 0.02% by weight of Zr.

The retention time from the point of the addition of the deoxidizing element to the point of initiation of the casting operation hereinafter referred to as "killing time" was adjusted to 30 seconds, and the cooling rate was adjusted to 50° C./min at temperatures of the liquidus line temperature to 1400° C. and to 40° C./min at temperatures of from 1400° C. to 1000° C. A sample was collected and the number of deoxidation products was determined by an X-ray micro-analyzer.

The relationship between the concentration of dissolved oxygen before the deoxidation and the number of deoxidation products is shown in FIG. 1. It is seen that the number of deoxidation products is largest when the concentration of dissolved oxygen before the deoxidation is about 40 ppm, and the number of deoxidation products drops remarkably when the concentration of dissolved oxygen before the deoxidation is lower than 20 ppm or higher than 60 ppm. Accordingly, it was confirmed that, when the concentration of dissolved oxygen before the deoxidation is 20 to 60 ppm, the deoxidation products are present in the quantity sufficient to provide nuclei for a precipitation of MnS, and a sufficient number of MnS precipitates acting as the IFP nuclei can be obtained.

TABLE 1

| Element | Content (% by weight) |
|---|---|
| C | 0.08 |
| Si | 0.20 |
| Mn | 1.0 |
| P | 0.015 |
| S | 0.005 |

Example 2

As a melting experiment of an ingot of 1 kg conducted by high-frequency induction heating, a steel having a composition shown in Table 1 was deoxidized with one element selected from the group consisting of Zr, Ti, Y, Hf and Ce. Prior to this deoxidation, preliminary deoxidation with Si and Mn was carried out to adjust the concentration of dissolved oxygen to 40 to 50 ppm. The killing time was adjusted to 30 seconds. The cooling rate was adjusted to 50° C./min at temperatures of from the liquidus line temperature to 1400° C. and to 40° C./min at temperatures of from 1400° C. to 1000° C.

Separately, Zr was added to a molten steel having a dissolved oxygen concentration of 15 ppm before the deoxidation, and 2 Nl of oxygen was blown into the melt. The other experimental conditions were the same as described above.

In the case of a comparative material, the deoxidation was carried out with Si and Mn, and then 1 g of $Fe_2O_3$ was added to the melt to adjust the dissolved oxygen concentration to a level exceeding 60 ppm. The deoxidation was then carried out with one member selected from the group consisting of Zr, Ti, Y, Hf and Ce. The killing time was adjusted to 30 seconds. At the casting operation, cooling was accomplished by Ar cooling and the temperature was not controlled.

Figure 2:
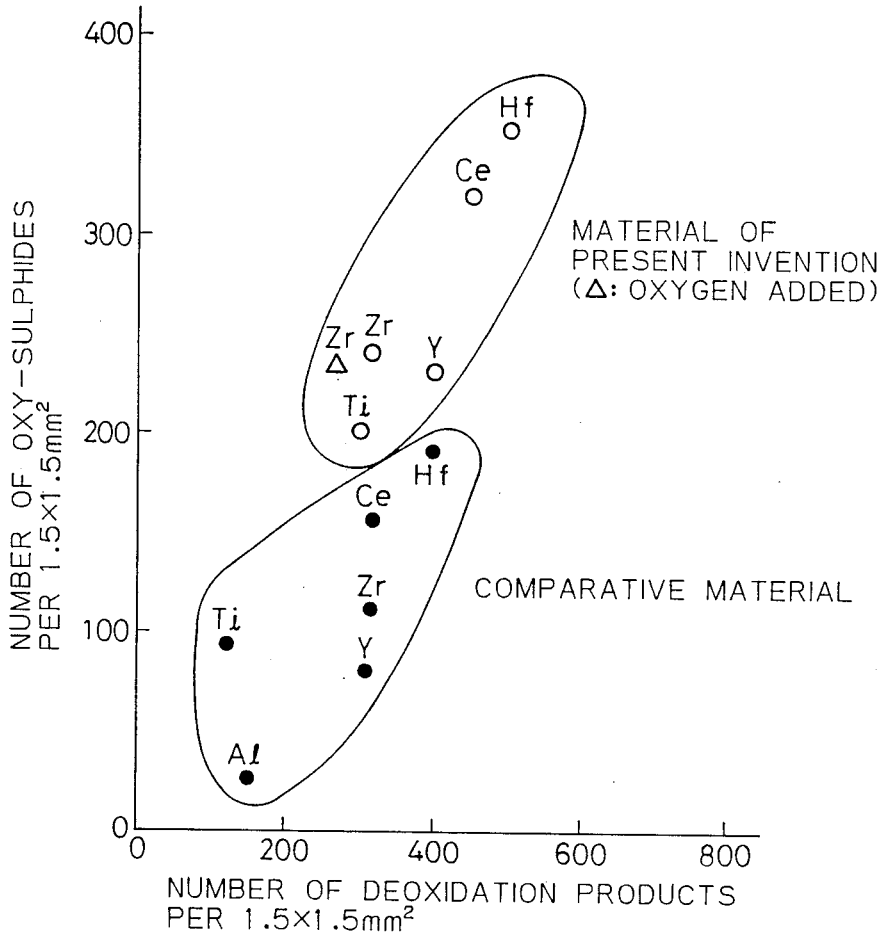
FIG. 2 illustrates the relationship between the number of deoxidation products and the number of oxy-sulphide precipitates.

With respect to the obtained ingot of 1 kg, the distribution of precipitates was examined by an X-ray microanalyzer. The relationship between the number of deoxidation products and the number of oxy-sulphide precipitates in each sample is shown in FIG. 2. It is seen that the number of oxy-sulphide precipitates increases with an increase of the deoxidation products. In the materials of the present invention, the number of deoxidation products and oxy-sulphide precipitates was satisfactory, but in the comparative materials, the number of deoxidation products and oxy-sulphide precipitates was too low.

EXAMPLE 3

As a melting test of an ingot of 1 kg by high-frequency induction heating, the dissolved oxygen concentration in a steel having a composition shown in Table 1 was adjusted to 40 to 50 ppm by preliminary deoxidation with Si and Mn, and deoxidation then carried out with one member selected from the group consisting of Zr, Ti, Y, Hf and Ce. The killing time was adjusted to 30 seconds. The cooling rate was adjusted to 50° C./min at temperatures of from the liquidus line temperature to 1400° C. and to 40° C./min at temperatures of from 1400° C. to 1000° C.

In the case of a comparative material, the killing time was adjusted to 10 minutes. The other conditions were the same as described above.

Figure 3:
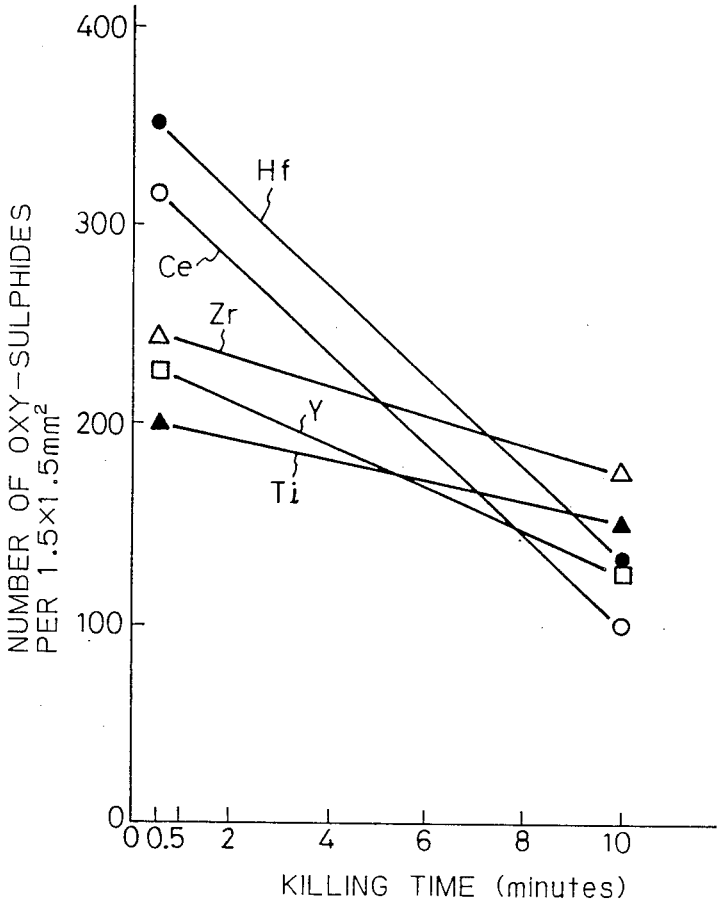
FIG. 3 illustrates the relationship between the retention time after the addition of the deoxidizing agent and the number of oxy-sulphide precipitates.

Then, with respect to each of the obtained ingots of 1 kg, precipitates were analyzed by an X-ray microanalyzer. The results (number of oxy-sulphide precipitates) are shown in FIG. 3. It is seen that, in the comparative materials, the number of oxy-sulphide precipitates was much lower than in the materials of the present invention.

Of the so-obtained samples, the Zr-deoxidized samples were observed by an electron microscope to examine the state of MnS. The results are shown in FIG. 4.

In FIG. 4, reference numeral 1 represents the deoxidation product ($ZrO_2$), and the periphery of the deoxidation product is surrounded by MnS [(Mn, Si)0, MnS] 2.

Figure 4A:
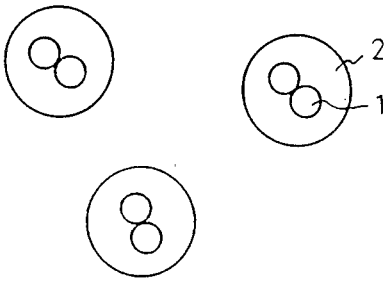
FIG. 4(A) shows the state of the steel material of the present invention.
Figure 4B:
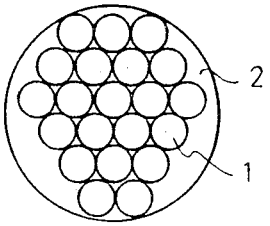
FIG. 4(B) is a similar view showing a comparative material.

In the material according to the present invention [FIG. 4(A)], the deoxidation products were finely dispersed and MnS was finely precipitated with the deoxidation products as the nucleus. In contrast, in the comparative material [FIG. 4(B)], the deoxidation products coagulated, and most of the deoxidation products rose and were released from the melt, with the result that the number of MnS precipitates was much lower than in the material of the present invention.

EXAMPLE 4

A melt having a composition shown in Table 1 was prepared in a vacuum melting furnace, and at a dissolved oxygen concentration of 60 ppm before the deoxidation, a cast ingot was prepared by carrying out the deoxidation with Zr. The ingot was hot-forged and machined to obtain a rod-shaped sample having a diameter of 15 mm. The sample was once made molten in a high-frequency induction heating furnace and the casting operation was carried out under the cooling rate conditions shown in Table 2. The number of deoxidation products and the number of oxy-sulphide precipitates were determined by an X-ray microanalyzer. The results are shown in Table 2. It is seen that, in the samples of the present invention, the number of oxy-sulphide precipitates was much higher than in the comparative samples.

TABLE 2

| Cooling Rate (°C./min) | | Number of Precipitates per 1.5 × 1.5 mm² | |
|---|---|---|---|
| liquidus line temperature to 1400° C. | 1400 to 1300° C. | deoxidation product | oxy-sulphide |
| Samples of Present Invention | | | |
| 50 | 50 | 300 | 200 |
| 50 | 30 | 300 | 240 |
| 200 | 30 | 700 | 500 |
| Comparative Samples | | | |
| 1000 | 1000 | 1500 | 60 |
| 200 | 200 | 700 | 20 |
| 3 | 3 | 70 | 40 |

Figure 5:
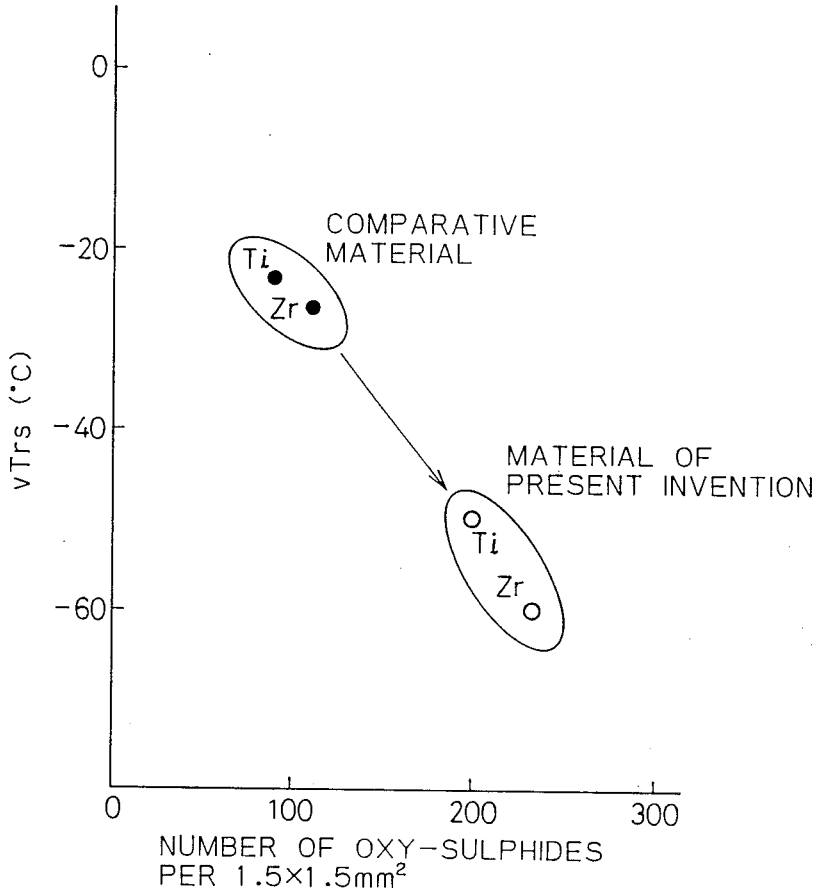
FIG. 5 illustrates the relationship between the number of oxy-sulphide precipitates and vTrs (° C.).

From the results obtained in the foregoing examples it is seen that, according to the process of the present invention, many fine oxy-sulphide precipitates were uniformly formed in the steel. It was confirmed that, as the number of oxy-sulphide precipitates increased, the HAZ toughness was improved. The relationship between the number of oxy-sulphide precipitates and the HAZ toughness is shown in FIG. 5. From FIG. 5, it is seen that the HAZ toughness is greatly improved with an increase of the number of oxy-sulphide precipitates.

Of the comparative materials and the materials of the present invention shown in FIG. 2, the Ti- and Zr-deoxidized materials were subjected to the reproduction heat cycle test. The results of the relationship between the number of oxy-sulphide precipitates and vTrs (° C.) are shown in FIG. 5. The chemical analysis values of the respective materials are shown in Table 3.

TABLE 3

| | C | Si | Mn | P | S | Ti | Zr |
|---|---|---|---|---|---|---|---|
| Ti ● | 0.09 | 0.21 | 0.99 | 0.014 | 0.004 | 0.024 | — |
| Ti O | 0.10 | 0.20 | 1.00 | 0.015 | 0.004 | 0.02 | — |
| Zr ● | 0.10 | 0.20 | 0.98 | 0.014 | 0.004 | — | 0.010 |
| Zr O | 0.09 | 0.19 | 0.99 | 0.015 | 0.005 | — | 0.010 |

Note
Marks "●" and "O" in Table 3 correspond to those in FIG. 5.

As apparent from the results obtained in the foregoing examples, according to the present invention, MnS can be finely dispersed and precipitated in a steel, and a steel material prepared from the casting obtained according to the present invention makes a great contribution to an improvement of the HAZ toughness in large constructions for which a variety of welding processes, from a small neat input welding to a large heat input welding, are required, for example, marine structures, ships and store tanks. Furthermore, steels having excellent characteristics such as cold cracking resistance, corrosion resistance, high-temperature creep, and banding processability can be manufactured, and the effects are conspicuous. Moreover, the process of the present invention can be utilized for dispersing MnS as an inhibitor of primary recrystallization in an electromagnetic steel or the like.

We claim:

1. A process for the preparation of a casting having MnS finely-dispersed and precipitated therein, which comprises the steps of casting in a casting mold a component-adjusted steel formed by adjusting a dissolved oxygen concentration to 20 to 60 ppm and adding 0.01 to 0.05% by weight of one element selected from the group consisting of Zr, Ti, Ce, Y and Hf, and cooling the formed casting while controlling an average cooling rate at a final solidification position of the casting so that the average cooling rate is at least 50° C./min at temperatures of from the liquidus line temperature to 1400° C. and the average cooling rate is 1 to 50° C./min at temperatures lower than 1400° C. but higher than 1300° C.

2. A process according to claim 1, wherein, at the step of adjusting the components of the molten steel, the dissolved oxygen concentration is adjusted to 20 to 60 ppm by an addition of a preliminary deoxidizing element.

3. A process according to claim 1, wherein, at the step of adjusting the components of the molten steel, a vacuum treatment is carried out to adjust the dissolved oxygen concentration to 20 to 60 ppm.

4. A process according to claim 1., wherein oxygen is added to the component-adjusted molten steel to adjust the dissolved oxygen concentration to 20 to 60 ppm.

5. A process according to claim 2 wherein the casting step is initiated within 10 minutes from the point of addition of the deoxidizing element.

6. A process according to claim 1, wherein the casting step of the steel is carried out by continuous casting.

7. A process according to claim 3, wherein the casting step is initiated within 10 minutes from the point of addition of the deoxidizing element.

8. A process according to claim 4, wherein the casting step is initiated within 10 minutes from the point of addition of the deoxidizing element.

9. A process for the preparation of a casting steel having MnS finely dispersed and precipitated therein, which comprises the steps of casting in a casting mold a component-adjusted steel formed by adding 0.01 to 0.05% by weight of one element selected from the group consisting of Zr, Ti, Ce, Y and Hf to a molten steel having a dissolved oxygen concentration lower than 20 ppm and adding oxygen capable of being bonded to the deoxidizing element in an amount corresponding to 20 to 60 ppm by weight, and cooling the formed casting while controlling the average cooling rate at the final solidification position of the casting so that the average cooling rate is at least 50° C./min at temperatures of from the liquidus line temperature to 1400° C. and the average cooling rate is 1 to 50° C./min at temperatures lower than 1400° C. but higher than 1300° C.

10. A process according to claim 9, wherein the casting step is initiated within 10 minutes from the point of addition of oxygen to the deoxidizing element-incorporated molten steel.

* * * * *